US005403414A

United States Patent [19]

Corston

[11] Patent Number: 5,403,414

[45] Date of Patent: Apr. 4, 1995

[54] METHOD AND APPARATUS FOR CONSTRUCTION OF FLOORING TO PREVENT SQUEAKS

[76] Inventor: Charles Corston, 501 Willow Court S., Bellingham, Wash. 98225

[21] Appl. No.: 76,274

[22] Filed: Jun. 11, 1993

Related U.S. Application Data

[63] Continuation of Ser. No. 761,686, Sep. 18, 1991, abandoned.

[51] Int. Cl.[6] ..... E04B 1/00; E04D 13/00

[52] U.S. Cl. ..... 156/71; 52/480; 52/403.1; 52/420; 52/393; 206/345

[58] Field of Search ..... 52/741, 393, 479, 460, 52/450, 481, 403, 420; 428/902; 206/345; 156/71

[56] References Cited

U.S. PATENT DOCUMENTS

| | | | |
|---|---|---|---|
| 2,187,087 | 1/1940 | Leary | 53/758 |
| 2,746,079 | 5/1956 | Tofani, Jr. | 16/42 R |
| 3,045,294 | 7/1962 | Livezey | 52/403 |
| 3,121,977 | 2/1964 | Bersudsky | 52/388 |
| 3,274,038 | 9/1966 | Karn | 156/247 |
| 3,310,452 | 3/1967 | Hartley et al. | 156/523 |
| 3,385,018 | 5/1968 | Harry | 52/403 |
| 3,390,494 | 7/1968 | Chappie | 52/126.6 |
| 3,439,406 | 4/1969 | Wallin | 29/450 |
| 3,487,533 | 1/1970 | Strom | 52/363 |
| 3,494,087 | 2/1970 | Jonell et al. | 52/396.09 |
| 3,499,255 | 3/1970 | Sweeney | 52/403 X |
| 3,579,941 | 5/1971 | Tibbals | 52/384 |
| 4,056,904 | 11/1977 | Dawdy | 52/434 X |
| 4,067,762 | 1/1978 | Rhoads | 156/250 |
| 4,126,977 | 11/1978 | Chisum | 52/233 |
| 4,301,635 | 11/1981 | Neufield | 52/483 X |
| 4,357,198 | 11/1982 | Ezquerro | 156/391 |
| 4,376,361 | 3/1983 | Michal | 52/241 |
| 4,486,263 | 12/1984 | Gomez | 156/523 |
| 4,600,466 | 7/1986 | Herrmann | 156/391 |
| 4,617,073 | 10/1986 | Scott | 156/107 |
| 4,620,403 | 11/1986 | Field | 52/408 X |
| 4,742,654 | 5/1988 | Cole | 52/58 X |
| 4,775,442 | 10/1988 | Januska | 156/575 |
| 4,831,806 | 5/1989 | Niese | 52/391 X |
| 4,849,063 | 1/1989 | McKinnon | 156/351 |
| 4,851,074 | 7/1989 | Uchida | 156/541 |
| 4,858,399 | 8/1989 | Salato | 52/105 X |
| 4,879,856 | 11/1989 | Jones et al. | 52/403.1 |
| 4,888,296 | 12/1989 | Lutz | 52/291 X |
| 4,914,883 | 4/1990 | Wencley | 52/309.5 |
| 5,148,644 | 9/1992 | Weir | 52/300 X |
| 5,179,813 | 1/1993 | Martinsen | 52/743 X |

*Primary Examiner*—David A. Simmons
*Assistant Examiner*—Charles Rainwater
*Attorney, Agent, or Firm*—Todd N. Hathaway

[57] ABSTRACT

A method of constructing a floor so as to prevent squeaking due to movement of the floor decking relative to the joists. The joists are installed, and strips of resiliently compressible cushioning tape are laid on the upper edges of the joists so that an adhesive side of the tape adheres thereto to keep the strip in position, and so that a non-adhesive side of the tape faces upwardly therefrom. Floor decking is placed on top of this so that the strip of tape is sandwiched between the decking and the joists, and the non-adhesive surface of the tape permits the decking to be slid thereover to a desired position. Fasteners are then driven through the decking and into the joist to secure the decking in position, and the resilient cushioning tape fills any gaps between the joists and the decking so as to prevent the decking from moving on the joists and causing squeaks. A tool for laying the strips of tape is made up of a handle portion and a spool portion. The spool portion has a peripheral channel which engages the upper edges of the joist, and the tape is wound in this channel with the adhesive side out so that this adheres to the joist and unrolls the tape as the spool is rolled along the joists using the handle.

6 Claims, 4 Drawing Sheets

METHOD AND APPARATUS FOR CONSTRUCTION OF FLOORING TO PREVENT SQUEAKS

This is a continuation of application Ser. No. 07/761,686, filed on Sep. 18, 1991, now abandoned.

FIELD OF THE INVENTION

The present invention relates generally to the construction of buildings having floor joists, and, more particularly, to a method for constructing such structures with a layer of cushioning material between the floor joists and the floor decking so as to prevent the development of squeaks in the finished structure.

BACKGROUND OF THE INVENTION

In most houses and many similar structures, the floors are conventionally constructed by installing a series of narrow floor joists to provide support, and then placing sheets of plywood or the like on top of these to form the flooring surface. The sheets of plywood are nailed to the joists, and then carpet, linoleum, or other floor covering is typically installed on top of the plywood.

Due to the increasing expense and difficulty of obtaining fully seasoned wood products, there has been an increasing tendency in the construction industry to install joists which are not as fully seasoned, nor perhaps as true, as the builder might otherwise like. Unfortunately, once the wood fully dries, its curvature often changes, and the resulting irregularities and misalignment of the edges of the joists with the overlying plywood frequently results in numerous squeaks in the floor of the finished building. These squeaks often occur where the plywood rubs up and down against the shaft of a nail, where there is a space or gap between the top of the joist and the plywood which permits the plywood to flex up and down as a person or other object moves across the floor. Because it is usually necessary to remove a ceiling and/or carpeting or other floor covering to get at the source of the problem, repairs to correct such squeaks are typically very expensive.

The conventional measure which has been adopted in the construction industry in an attempt to overcome the problem of floor squeaks is to glue the plywood sheets to the joists using a conventional wood glue or the like. This technique has been marked by very modest success. Very commonly, once the wood has dried out, the resulting irregularities and misalignments become so great that the dried glue simply cracks or breaks and so does nothing to prevent the squeaks from developing. Also, because such glues set up within a limited period of time after they have been dispensed from their containers, the builder is obliged to place the plywood on the floor joists almost immediately after the glue has been laid thereon, which interferes with the builder's flexibility in managing the project; furthermore, in very hot or very cold climates, the glue tends to set up excessively fast, which aggravates this problem. Also, most such glues cannot be used when it is raining. Still further, once the glue has been placed on the floor joists, the construction crew can no longer walk about on the tops of the joists, which makes it very difficult to position and install the sheets of plywood, and when the crew slides the sheets of plywood along the tops of the joists into place, the edges of the sheets often scrape the glue off of the joists so that there is virtually none left to bond to the plywood.

An additional problem which is encountered using the conventional construction methods described above is a lack of sound insulation between vertically adjoining rooms, as in an apartment complex. Impact noises, such as those of a person walking or dropping an object on the floor, are readily transmitted directly through the floor joists to the ceiling of the vertically adjoining room. While systems have been proposed for sound insulation of such floors, these have normally been prohibitively difficult and expensive to construct, particularly for use in low-cost construction projects such as public housing apartments, motels, and the like. And, of course, the conventional glueing technique described in the preceding paragraph does nothing to prevent the transmission of impact noises through the floor joists.

Accordingly, there exists a need for a method of constructing the floors of houses and like structures which eliminates squeaks, and which compensates for irregularities and misalignments which occur when the wooden floor joists dry out. Furthermore, there is a need for such a method which can be easily practiced in a variety of weather conditions without constraining the builder's schedule, and which eases the task of moving about on the floor joists to align and install the sheets of plywood flooring. Still further, there exists a need for such a method which also helps reduce the transmission of impact sounds in a vertical direction between adjoining rooms in a structure.

SUMMARY OF THE INVENTION

The present invention has solved the problems cited above, and comprises generally a method of constructing the floor of a structure so as to prevent squeaking of the floor due to movement of the decking thereof relative to the joists which support the decking. The method comprises the steps of installing a floor joist and laying a strip of adhesive cushioning tape on an upper edge of the joist so that an adhesive side of the tape adheres to the joist so as to keep the strip in position, and so that a non-adhesive side of the tape faces upwardly therefrom, this adhesive cushioning tape being formed of a resiliently compressible material. The floor decking is placed on top of the strip of cushioning tape so that the tape is sandwiched between the decking and the joist, and the decking may be slid over the non-adhesive surface of the strip of tape to a desired position. Fasteners are then driven through the floor decking and into the joist so as to secure the decking in the desired position, and so that the resilient cushioning tape is partially compressed and fills any gaps between the upper edge of the joist and the decking so as to prevent the decking from moving on the joist and causing squeaks.

The step of laying the strip of tape on the edge of the joist may comprise the steps of providing a spool of this tape, with the tape being wound on the spool so that the adhesive side faces outwardly therefrom, positioning this spool on the edge of the joist so that the adhesive side of the tape adheres thereto, and then rolling the spool along the edge of the joist so that the adhesive side of the tape holds the strip in place on the edge of the joist as it is unrolled from the spool. The step of positioning the spool on the edge of the joist may comprise positioning the upper edge of the joist in a channel which is formed about the periphery of the spool for engaging the edge of the joist and guiding the spool for rolling movement along the joist, the adhesive cushioning tape being wound in this channel.

A floor constructed in accordance with the present invention comprises at least one floor joist having an upper edge, a strip of the adhesive cushioning tape being laid along this edge so that the adhesive side of the tape adheres to the joist to keep the strip in position and the non-adhesive side of the tape faces upwardly therefrom. There is floor decking positioned on top of the strip of cushioning tape so that the strip of tape is sandwiched between the decking and the joist, and there are fasteners driven through the decking and into the joist so as to secure the decking in its desired position, and so that the resilient cushioning tape is partially compressed and fills any gaps between the edge of the joist and the decking so as to prevent the decking from moving on the joist and causing squeaks.

Also in accordance with the present invention, there is a tool for applying the adhesive cushioning tape to the upper edge of the floor joist. This tool may comprise a handle portion which is configured to be held by an operator, and a spool portion mounted for rotation on the lower end of the handle portion, the spool portion having a peripheral channel which is sized to engage the edge of the joist for guiding the spool for rolling movement along the joist. The adhesive cushioning tape is wound in this peripheral channel with the adhesive side out, so that in response to positioning the spool on the upper edge of the joist and manipulating the handle so as to roll the spool along this, a strip of the tape is unrolled from the spool and adheres to the upper edge of the joist with its non-adhesive side facing upwardly therefrom.

Preferably, the spool portion of this tool comprises a replaceable roll of the adhesive cushioning tape wound about a hollow cylindrical core, with inner and outer flanges abutting the sides of this and extending radially beyond the outer edge of the roll of tape so as to form the channel for engaging the edge of the joist, the outer edges of the flanges being spaced apart by the width of the roll of tape. The flanges are held together by a central hub assembly, which may be made up of first and second hub halves, each of these having a cylindrical outer drum portion which is sized to fit within and engage the interior surface of the hollow core of the roll of tape, a radially extending flange portion at an outer end of the drum portion, and an inner axial tube portion. The hub halves are inserted through central openings in the inner and outer flanges of the spool so that the drum portions engage the inner surface of the hollow core and the flange portions abut the outer surfaces of the two flanges so as to retain these in abutment with the sides of the roll of tape. The tube portions of the hub halves line up coaxially so as to form a continuous bore for receiving an axle. This may be a stub axle which is mounted to the lower end of the handle portion; the stub axle may comprise a shaft portion having an inner end in abutment with the handle portion and an outer end, with an outwardly extending bearing shoulder being formed about the shaft proximate its inner end for abutting the first hub half so as to limit lateral movement of the spool towards the handle. A bolt passes through the handle and the shaft, and has an outer end onto which a nut is threaded, this nut having an inner bearing surface for limiting lateral movement of the spool away from the handle portion. The axle shaft and nut may be fabricated of low-friction nylon material.

Objects and advantages of the invention not clear from the above will be understood by a reading of the detailed description of the invention and a review of the accompanying drawings.

DETAILED DESCRIPTION

Figure 1:
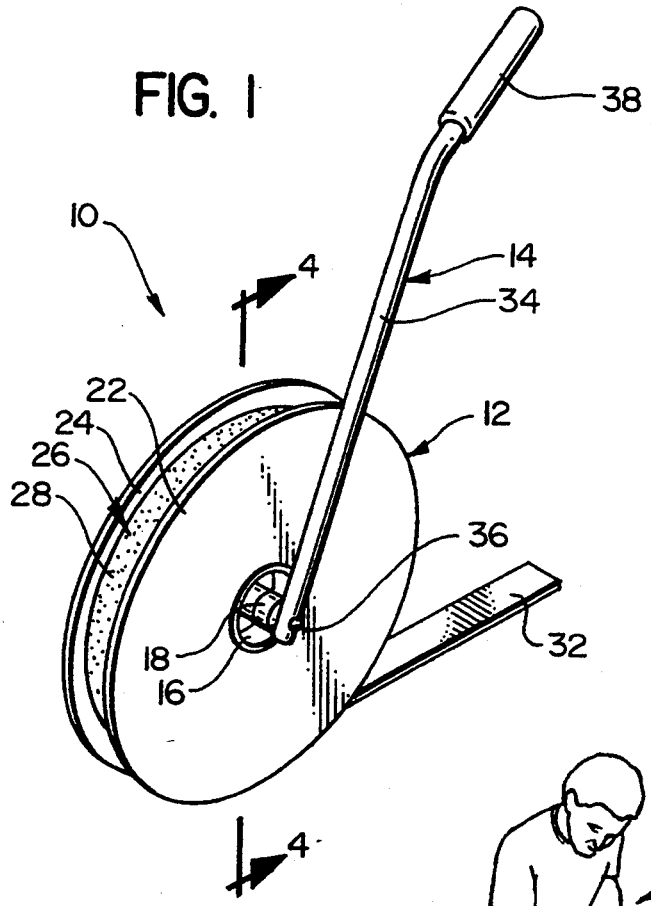
FIG. 1 shows a perspective view of a hand-operated tool for applying an adhesive strip of cushioning tape to the top of a floor joist in accordance with the present invention.

FIG. 1 shows a hand-operated tool 10 for applying adhesive cushioning tape to the top of floor joists in accordance with the present invention. Tool 10 comprises generally a spool portion 12 and a handle portion 14. As will be described in greater detail below, spool portion 12 is provided with a central hub 16 which receives and rotates about an axle 18 which extends from the handle portion of the tool. First and second flanges 22, 24 extend from hub 16 and, as will be described below, are spaced apart to form a gap which receives the top edge of the floor joist. A roll of adhesive cushioning tape 26 is contained between the two flanges 22, 24, and this is wound on the roll in a "reverse" manner so that the adhesive side 28 of the tape faces outwardly on the roll, contrary to the usual arrangement of rolls of adhesive tape. Consequently, as the roll of tape is rolled along an underlying surface (i.e., the floor joist), the adhesive side 28 of the tape adheres thereto so that the tape unrolls from the spool, leaving the non-adhesive side 32 of the tape exposed and facing upwardly from the joist.

As noted above, axle 18 is a part of handle portion 14; in the embodiment illustrated, axle 18 is mounted at right angles to the lower end of a rod-like handle 34 by means of a bolt 36. Preferably, handle 34 may be about 2′ in length with the length of 22″ being an excellent compromise in terms of both handling ease and convenience when packaging for distribution (using standard 24"-long boxes). Handle 34 may be fabricated of any suitable material; ¾" tubular metal electrical conduit has been found to be an eminently suitable material for this application, from the standpoint of low cost, ease of fabrication, and light weight. The upper end of handle 34 is bent slightly rearwardly (e.g., about 10°–20°) from the main shaft of the handle to provide a more horizontal portion which can be conveniently held in the hand of a standing operator. A hand grip 38 is installed on the upper end of handle 34 (for example, a cushioning foam rubber hand grip), and the open upper end of the tubular handle itself may preferably be closed by a suitable plug (not shown).

The use of tool 10 to install the adhesive cushioning tape in accordance with the method of the present invention will be discussed below. However, before proceeding to that, a description of the tape material itself will be provided. The width of the tape preferably corresponds generally to the width of the top of the floor joist on which it is to be installed; for most typical residential construction, floor joists are 2"×8", 2"×10", or 2"×12" boards, which have edge thicknesses of roughly 1½–1 5/8", and so the tape may preferably be cut to about this width. The adhesive cushioning tape essentially forms a resilient gasket between the floor joists and the overlying decking material (e.g., sheets of plywood), and serves several functions: firstly, the tape provides a compressible material which compensates for or "smooths out" irregularities and discontinuities between the plywood and the underlying floor joist so as to eliminate any gaps which would permit the plywood to work up and down and cause squeaks, and secondly it serves a shock-absorbing function which helps prevent the transmission of sound vertically through the floor. The tape is thus preferably fabricated of a resilient, shock-absorbing material, and an eminently suitable material for this is closed-cell polyethylene foam; other examples of material which may be suitable include vinyl and rubber foam. Unlike conventional glue, the polyethylene foam material retains its resilience indefinitely, with the life expectancy of this material in service being roughly equivalent to that of the house itself. Suitable thicknesses for the tape have been found to range from about ¼" thick downwardly, with 1/16" being preferable for many applications. When it is installed beneath nailed-down plywood decking, the foam tape compresses to a certain degree; for example, it may condense down to about 50% of its original thickness. However, even when partially compressed, it retains the necessary resilience to perform the functions noted above. The adhesive side 28 of the tape is impregnated or coated with a suitable adhesive material, such as a rubber-based pressure sensitive adhesive, with this preferably being sufficiently soft and adhesive to adhere to bare wood, even if somewhat damp. The non-adhesive side 32 of the tape is preferably tough and slick so as to permit the plywood sheets or other decking to be slid over this without damaging the tape. Preferably, this may be accomplished by covering the adhesive side of the tape with a thin (e.g., 1–4 mil) polyester liner which is adhered to the underlying foam tape with a thin layer of adhesive; alternatively, the non-adhesive side of the tape may be covered with a release paper, or may be sealed with an integral coating or by heat-sealing. Consequently, it will be understood that, for most applications, it is not intended that the tape serve to "glue" or hold the overlying plywood or other decking in place, the intended purpose of the adhesive rather being to facilitate the laying of the strip of tape and holding it in place until the plywood flooring is laid on top of it. Because the upper surface of the tape is non-adhesive, the personnel installing the floor can walk about on top of the tape after it has been put down, and can easily slide the plywood sheets into position over the surface of the tape without these catching or sticking on the tape and damaging it. The plywood sheets (or other decking) are then secured in place by nails, screws, or like fasteners. Of course, use of the cushioning tape as described above also eliminates the problems of excessively quick setting-up times which are associated with the use of conventional glues.

Figure 2:
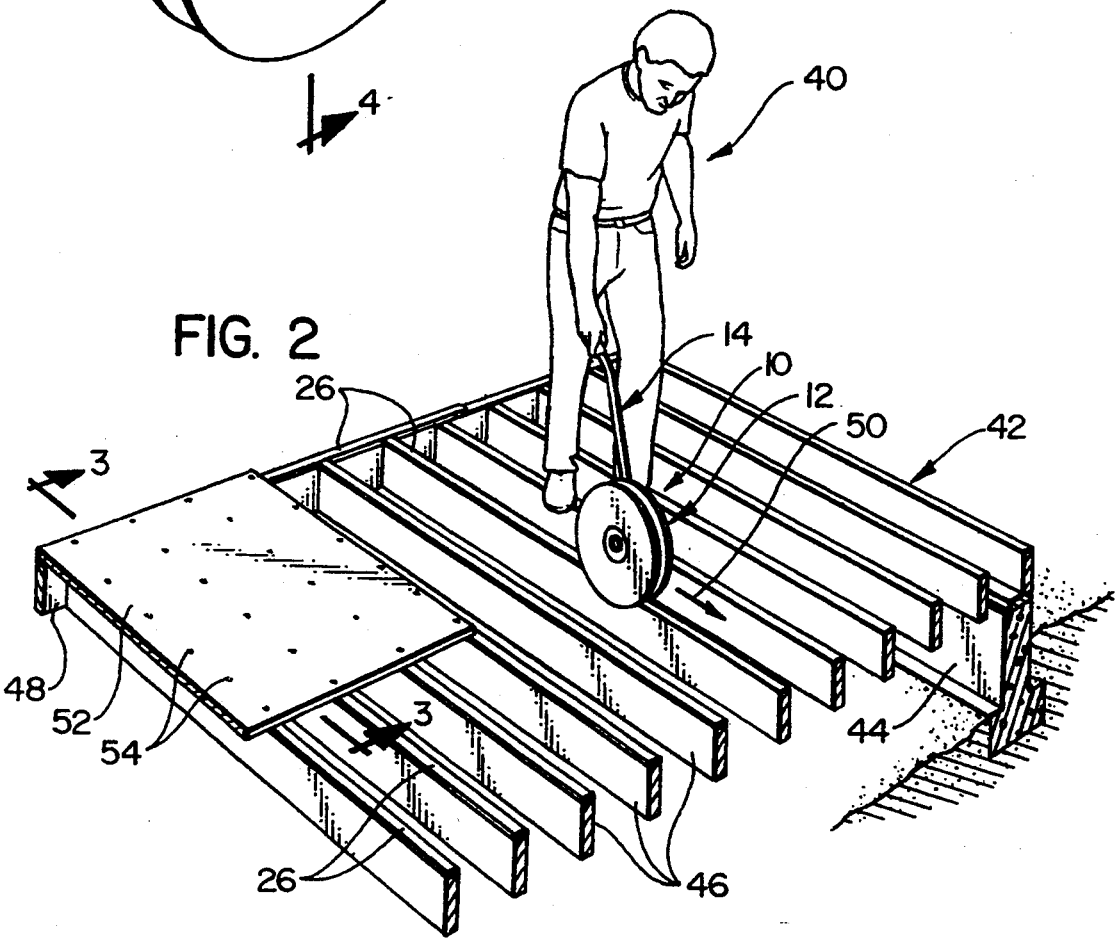
FIG. 2 shows a perspective view of an operator employing the tool of FIG. 1 to lay the strips of adhesive cushioning tape on top of installed floor joists, with a sheet of plywood floor decking being shown installed on top of a portion of these.

FIG. 2 shows an operator 40 using the tool 10 to install the above-described adhesive cushioning tape in a floor system 42. Floor system 42 is provided with a generally conventional foundation 44, which supports a series of parallel, spaced apart floor joists 46 joined together at their ends by headers 48. As was noted above, for residential construction the floor joists 46 may typically be 2"×12" boards or the like, laid on edge.

To lay the cushioning adhesive tape on top of these floor joists, the operator unrolls a bit of the tape and starts this at the desired point on the joist, and then slips the top of the joist into the circumferential channel formed between the two flanges of the spool so that the outer adhesive surface of the roll of tape contained therein contacts and adheres to the joist. The operator then grasps hand grip 38, and, using handle 34, rolls spool 12 along the top of the floor joist in the direction indicated by arrow 50. As this is done, the tape unrolls from the spool and is laid in place on top of a joist. If desired, the tape can also be laid along the top of the header 48, as is shown in FIG. 2. The plywood sheets 52 which make up the decking of the floor are then slid into place, with the operators being able to walk about on the non-adhesive surface of the tape and slide the sheets of plywood across this as previously described without fear of damaging the tape or getting the plywood stuck in the wrong spot. Once the plywood sheet has been positioned in its desired final location, the installation is completed by nails 54 or like fasteners, which are driven through the plywood 52 and tape 26 into the wooden floor joist 46.

Figure 3:
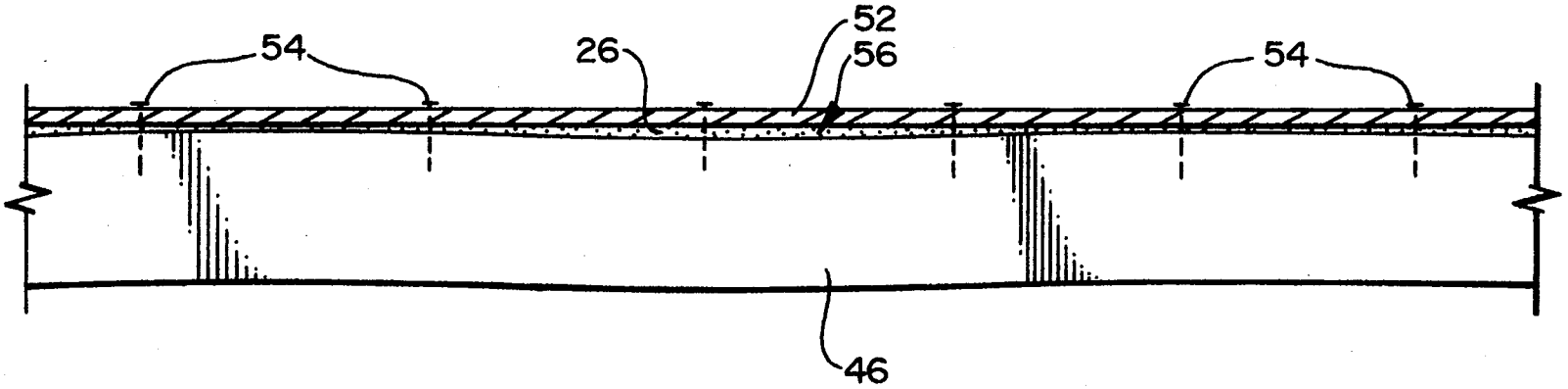
FIG. 3 is a cross-sectional view taken along line 3—3 of FIG. 2, showing one of the strips of resilient cushioning tape partially compressed between a joist and the overlying plywood decking, and filling a gap between these so as to prevent the plywood from working up and down against the shanks of the nails.

FIG. 3 shows a cross-section through the flooring system having the cushioning tape installed between the upper edges of the joists and the overlying plywood decking as described above. In particular, FIG. 3 shows how the uneven upper edge of a joist 46 (which may be the result of warping or bowing of the joist as it has dried out, as discussed above) causes discontinuities or gaps 56 between it and the planar sheet of plywood 52, which, if left unfilled, would permit the plywood to flex up and down as people walked across it, causing squeaks as the plywood worked against the shanks of nails 54. However, the resilient cushioning tape 26 installed in accordance with the present invention is partially compressed between the joist and the plywood so that this smooths out these irregularities and fills the gaps 56 so as to prevent the plywood from flexing downwardly by an appreciable distance under a person's weight, thus eliminating the vertical movement of the plywood which causes the squeaks. Furthermore, floor decking is typically installed using ring nails; as these are driven through the strip of resilient cushioning tape, a portion of this material is picked up in the grooves along the shank of the ring nail, and in the event that the nail subsequently lifts (as, for instance, if the space between the nails is excessive and the plywood bows due to becoming wet), the cushioning material which is retained along the shank of the nail serves as additional assurance against squeaks developing. The insulating layer provided by the cushioning tape also eliminates the direct wood-to-wood contact between the plywood and the joist, so as to prevent impact noises from being transmitted from the plywood to the joist and so to the ceiling of the room below.

Having completed a description of the major components and aspects of the present invention, a number of additional aspects of the tool and method incorporating the present invention will now be described.

Figure 4:
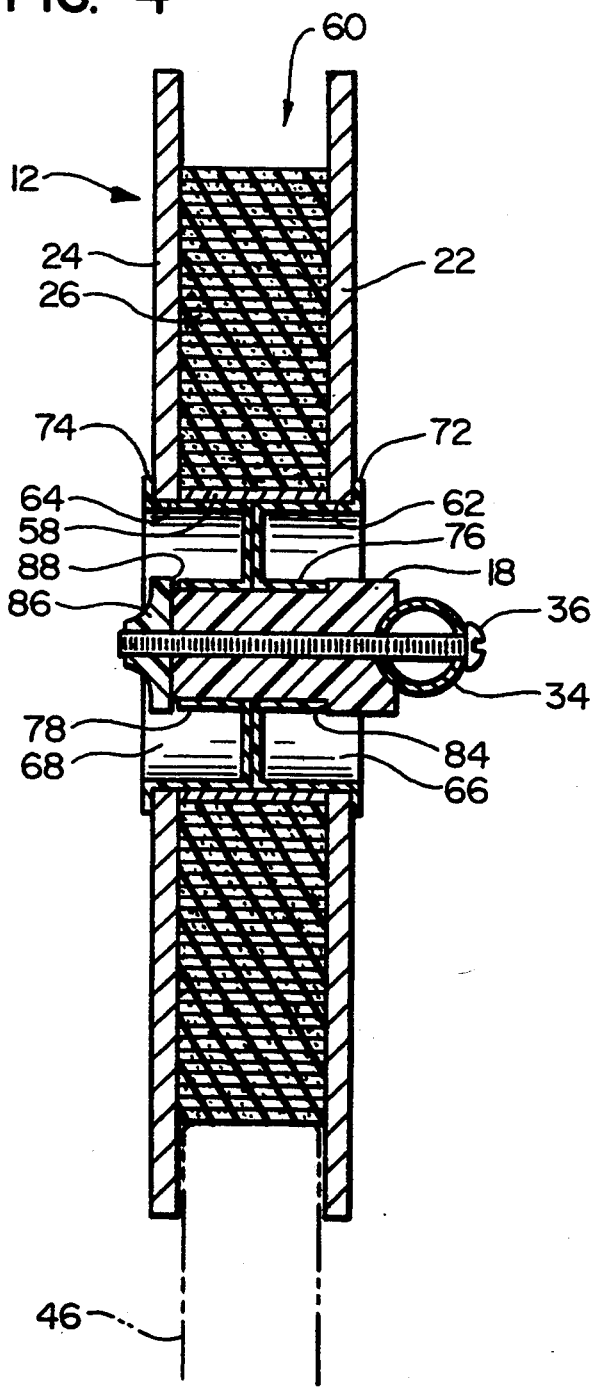
FIG. 4 is a cross-sectional end view taken along line 4—4 of FIG. 1, showing the configuration of the tape spool of the tool and how this fits onto the top of a floor joist.

FIG. 4 shows a cross-sectional view of the spool portion 12 of tool 10. For reasons of economy, the rolls of tape 26 are supplied from the manufacturer wound on small, cylindrical cardboard cores 58; as each of these rolls becomes depleted, it is removed from the spool and replaced with a fresh one. To assemble spool 12, one of these rolls of tape is placed between the two parallel, circular flanges 22, 24; since the width of the tape is sized to correspond to the edge width of the joist 46, the two parallel flanges 22, 24 are spaced apart from one another by the roll of tape so as to form a peripheral recess or channel 60 which receives the upper edge of the joist so as to guide the spool as this is pushed along by the operator. The circular flanges 22, 24 (which may be formed of heavy duty cardboard, plastic, or other suitable material) each have a circular central opening 62, 64 having a diameter which corresponds generally to the inside diameter of the cardboard core 58. To secure the flanges to the roll of tape, drum-like, preferably identical inner and outer hub halves 66, 68 are inserted through each of the openings 62, 64; the external diameters of the hub halves are sized to form an interference fit with the inner surface of cardboard core 58, and may be provided with external ribbing to enhance this engagement. They are also each provided with a radially extending outer flange 72, 74 which abuts the outer surface of the associated circular flange 22, 24 adjacent to its central circular opening so as to hold this against lateral movement.

Each of the hub halves 66, 68 has a cylindrical central sleeve portion 76, 78, and these line up coaxially with one another when the hub halves are installed, so as to form an axial central bearing sleeve for the spool portion. This receives the stub axle 18 which extends from the end of handle 34, so that the spool rotates freely thereon. Stub axle 18 may be formed of a suitable, low friction material such as nylon, for example, and has a semi-cylindrical groove formed on its inner end which receives the outer wall of the cylindrical shaft of handle 34 in abutment therewith so as to prevent rotation of stub axle 18 relative to handle 34. A radially extending shoulder 84 is also formed about axle 18 near its inner end, and this limits the lateral motion of the spool assembly in this direction so as to keep it spaced away from the shaft of handle 34. The outer end of stub axle 18 extends through sleeve portions 76, 78; a bolt 36 also extends axially through axle 18 to its outer end, where a wing nut 86 is threaded onto the end of the bolt so as to retain the spool on the axle. Wing nut 86 has a radially extending flange portion 88 which abuts the outer end of sleeve portion 78 so as to limit lateral movement of the spool in this direction, and wing nut 86 may also be fabricated of a suitable material, such as nylon, for minimizing friction at this contact point.

Figure 5:
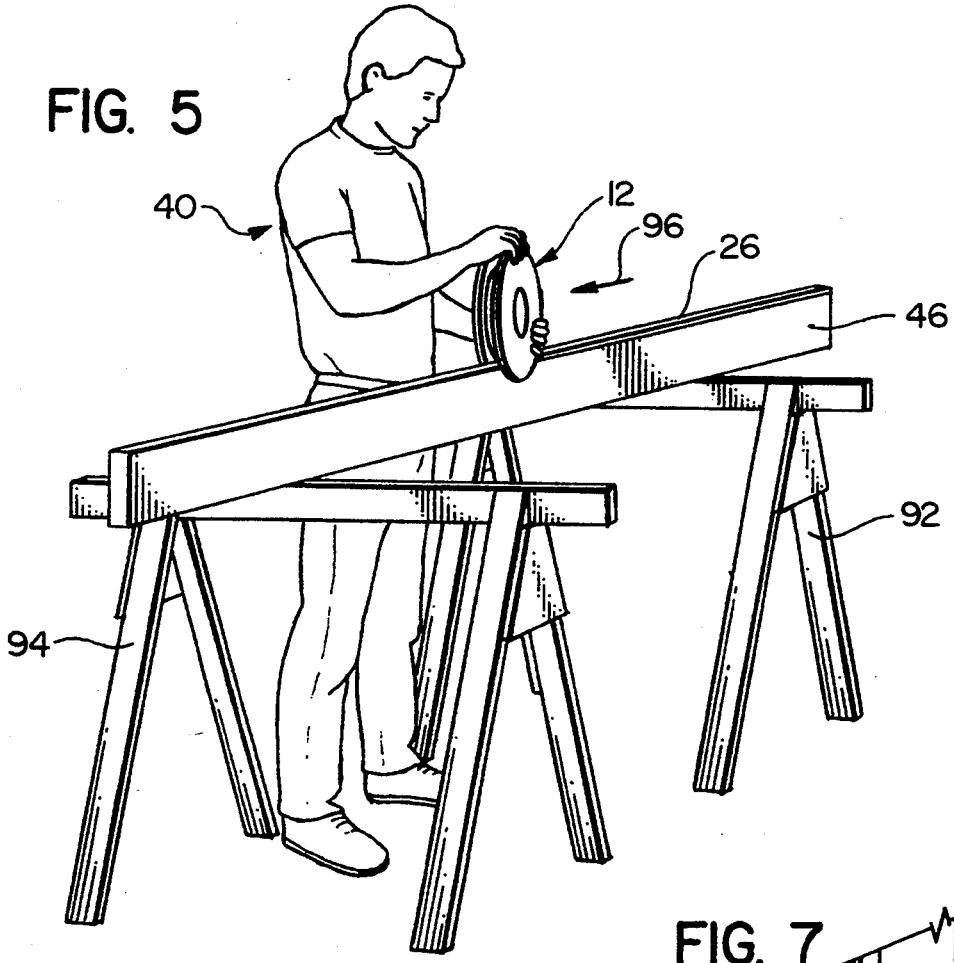
FIG. 5 is a perspective view of an operator using a spool of the cushioning adhesive tape similar to that shown in FIG. 1, but without the handle assembly, to lay a strip of the tape on top of a joist prior to its installation.
Figure 6:
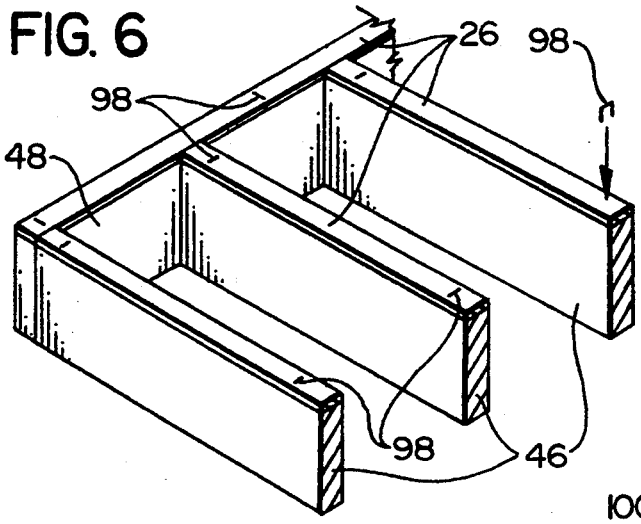
FIG. 6 is a perspective view somewhat similar to that of FIG. 2, showing the use of staples to assist in holding the adhesive cushioning tape in place in conditions where the joists are so wet as to interfere with the tape initially adhering thereto.
Figure 7:
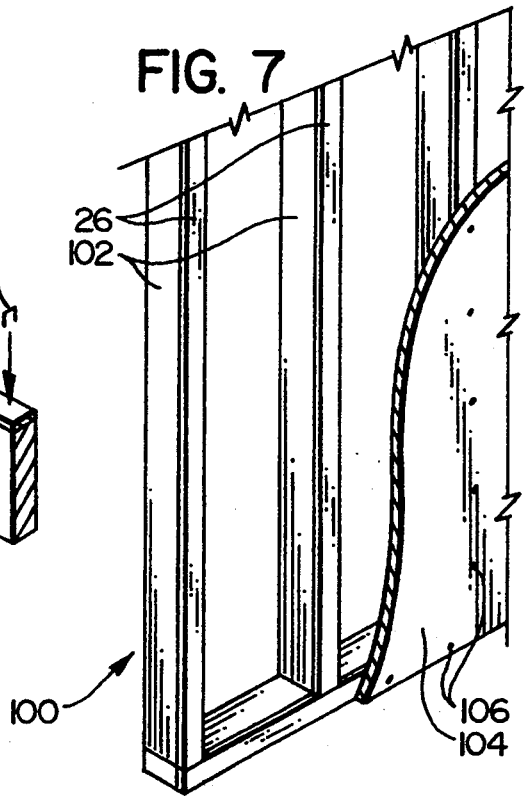
FIG. 7 is a perspective view of a portion of a vertically extending wall, with strips of the adhesive cushioning tape having been laid on the edges of the studs thereof in accordance with the present invention, and sheets of wallboard or the like having then been installed on top of these.

FIGS. 5–7 illustrate additional techniques which may be used for implementing the method of the present invention.

FIG. 5 shows the operator 40 laying the strip of adhesive tape 26 on a floor joist 46 prior to this being installated. This technique particularly lends itself to the construction of upper floors of a house or the like, or wherever the building conditions (or the project schedule) render it preferable to lay the tape strip on the joist prior to the latter being put in place in the structure. To do this, the operator places the floor joist on a suitable support, such as the saw horses 92, 94 shown in FIG. 5, so that the joist is positioned more-or-less at waist level, and then removes the handle portion from the spool portion of tool 10. The spool portion 12 can then be grasped in the operator's hands as shown in FIG. 5, and rolled along in this manner in the direction indicated by arrow 96 to lay the strip of cushioning tape on the upper edge of joist 46. The joist can then be lifted or otherwise transported to its installation site.

FIG. 6 shows the use of staples 98 to help hold the strips of adhesive cushioning tape 26 on the upper edges of the floor joists 46 after they have been laid out thereon. This technique may be desirable when the conditions are so wet that the adhesive material of the cushioning tape alone has difficulty holding the tape in place, especially when people are walking or sliding sheets of plywood across the top of the tape. In other words, this technique may be employed when the wooden floor joists are simply so wet that the tape won't effectively stick to them although, as was noted above, it has been found that suitable adhesive polyethylene foam tape will stick to even quite damp joists. It will be appreciated, however, that using the staples to hold the tape in place is only a supplemental measure, and once the wood dries out the adhesive side of the tape will begin to adhere to the joist so as to permanently hold the tape in position in the manner previously described.

FIG. 7 illustrates the use of the present invention in the construction of a vertically extending wall system 100. This approach provides an inexpensive and effective approach to sound insulation of walls so as to prevent the transmission of sound therethrough to adjoining rooms; as noted above, sound may be transmitted vertically through conventional wooden floor joists, and it may be likewise transmitted through the studs in walls. In its overall configuration, wall system 100 is very similar to the floor system shown in FIG. 2, except that there are vertically extending studs 102 instead of the horizontally extending joists 46. As is shown in FIG. 7, the strips of adhesive cushioning tape 26 are laid on the edges of studs 102, using techniques similar to those described above, and then a suitable wall surface material such as plasterboard 104 or the like is laid over this and secured in place using nails 106, screws, or other suitable fasteners. When implementing the method of the present invention in this manner, it may be found preferable in some embodiments to provide the outwardly facing surface of the tape strip with a certain degree of adhesiveness (as compared with the lack of adhesiveness of non-adhesive surface 32 described above) so that this can be used to help hold the wallboard in place initially while the operator gets the fasteners started. Of course, in such an embodiment it would still be desirable to limit the adhesiveness of the surface of the tape or otherwise configure the tape so that it could readily be reeled off of the roll in the manner described above.

Having described the invention in its preferred embodiments, it will be clear that changes and modifications may be made without departing from the spirit of the invention. It is therefore not intended that the words used to describe the invention or the drawings illustrating the same be limiting on the invention. Rather, it is intended that the invention only be limited by the scope of the appended claims.

What is claimed is:

1. A method of constructing a floor of a structure so as to prevent squeaking of said floor dub to movement of the decking thereof relative to floor joists which support said decking, said method comprising the steps of:

installing a said floor joist;

laying a strip of adhesive cushioning tape on an upper edge of said joist so that an adhesive side of said tape adheres to said joist so as to keep said strip in position, and, so that a flat, continuous, non-adhesive side of said tape faces upwardly from said edge of said joist, said adhesive cushioning tape being formed of a resiliently compressible material;

placing a floor decking on top of said strip of cushioning tape so that said strip of tape is sandwiched between said decking and said joist;

sliding said decking over said flat, continuous, non-adhesive surface of said strip of tape to a desired position; and driving fasteners through said floor decking and into said joist so as to secure said decking in said desired position, and so that said resilient cushioning tape is partially compressed so as to fill gaps between said upper edge of said joist and said decking so as to prevent movement of said decking on said joist which could cause said squeaking;

wherein the step of laying said strip of adhesive cushioning tape on said edge of said joist comprises:

providing a stool of said adhesive cushioning tape, said tape being wound on said spool so that said adhesive side of said type faces outwardly therefrom;

positioning said spool on said upper edge of said joist so that said adhesive side of said tape adheres to said joist; and rolling said spool along said edge of said joist so that said adhesive side of said tape which said joist holds said strip of tape in place on said edge of said joist as said strip is unrolled from said spool along the length of said joist; and wherein the step of positioning said spool on said upper edge of said joist further comprises positioning said upper edge of said joist in a channel formed about the periphery of said spool for engaging said edge of said joist so as to guide said spool for rolling movement along said joist, said adhesive cushioning tape being wound in said peripheral channel of said spool.

2. The method of claim 1, wherein the step of installing said floor joist comprises:

installing said joist prior to the step of laying said strip of adhesive cushioning tape on said upper edge thereof.

3. The method of claim 1, wherein the step of installing said floor joist comprises:

installing said joist following the step of laying said strip of adhesive cushioning tape on said upper edge thereof.

4. The method of claim 1, wherein the step of placing a floor decking comprises:

placing sheets of generally planar decking material on top of said strip of tape so that undersurfaces of said sheets are in contact with said tape over longitudinally extending portions of said joist.

5. The method of claim 4, wherein the step of sliding said decking over said non-adhesive side of said strip of tape to a desired position comprises:

sliding said sheets of decking material over said tape and along said joist to a position in which edges of said sheets are in abutment with one another, so that said sheets form a continuous planar floor surface along and across said joist.

6. The method of claim 4, wherein the step of driving fasteners through said decking and into said joist comprises:

driving fasteners through said sheets of decking material and into said joist along said longitudinally extending portions thereof so that said sheets are secured in said desired position, and so that said resilient cushioning tape is partially compressed so as to fill gaps between said planar sheets of decking material and warped sections of said longitudinally extending portions of said joist.

* * * * *